US005167914A

United States Patent [19]

Fujimura et al.

[11] Patent Number: 5,167,914

[45] Date of Patent: Dec. 1, 1992

[54] RARE EARTH MAGNET HAVING EXCELLENT CORROSION RESISTANCE

[75] Inventors: Setsuo Fujimura, Kyoto; Masato Sagawa, Nagaokakyo; Hitoshi Yamamoto, Osaka; Satoshi Hirosawa, Nagaokakyo, all of Japan

[73] Assignee: Sumitomo Special Metals Co., Ltd., Osaka, Japan

[21] Appl. No.: 704,100

[22] Filed: May 22, 1991

Related U.S. Application Data

[63] Continuation of Ser. No. 561,378, Aug. 1, 1990, abandoned, which is a continuation of Ser. No. 326,437, Mar. 21, 1989, abandoned, which is a continuation of Ser. No. 901,736, Aug. 29, 1986, abandoned.

[30] Foreign Application Priority Data

Aug. 4, 1986 [JP] Japan ..... 61-182998

[51] Int. Cl.[5] ..... B22F 1/00

[52] U.S. Cl. ..... 419/11; 419/12; 419/33; 419/57; 75/243; 75/244; 75/254; 148/101; 148/105; 252/62.55; 241/3; 241/15

[58] Field of Search ..... 419/11, 12, 33, 57; 75/243, 244, 246, 254; 148/105, 101; 252/62.55; 241/3, 15

[56] References Cited

U.S. PATENT DOCUMENTS

| | | | |
|---|---|---|---|
| 4,767,450 | 8/1988 | Ishigaki et al. | 75/0.5 BA |
| 4,995,905 | 2/1991 | Sagawa | 75/244 |
| 5,000,800 | 3/1991 | Sagawa | 148/302 |
| 5,009,706 | 4/1991 | Sakamoto et al. | 75/244 |
| 5,013,411 | 5/1991 | Minowa et al. | 204/29 |
| 5,022,939 | 6/1991 | Yajima et al. | 148/302 |
| 5,049,208 | 9/1991 | Yajima et al. | 148/302 |

*Primary Examiner*—Richard D. Lovering
*Assistant Examiner*—N. Bhat
*Attorney, Agent, or Firm*—Fish & Richardson

[57] ABSTRACT

An (Fe, Co)-B-R tetragonal type magnet having a high corrosion resistance, which has a boundary phase stabilized by Co and Al against corrosion, and which consists essentially of:

0.2–3.0 at % Dy and 12–17 at % of the sum of Nd and Dy;
5–10 at % B;
0.5–13 at % Co;
0.5–4 at % Al; and
the balance being at least 65 at % Fe.
0.1–1.0 at % of Ti and/or Nb may be present. Alloy powders therefor can be also stabilized.

19 Claims, 7 Drawing Sheets

A : SURFACE-TREATED
B : UNTREATED

A : SURFACE-TREATED
B : UNTREATED

RARE EARTH MAGNET HAVING EXCELLENT CORROSION RESISTANCE

This application is a continuation of U.S. application Ser. No. 07/561,378, filed Aug. 1, 1990, which in turn is a continuation of U.S. application Ser. No. 07/326,437, filed Mar. 21, 1989, now abandoned, which in turn is a continuation of U.S. application Ser. No. 07/901,736, filed Aug. 29, 1986, now abandoned.

BACKGROUND OF THE INVENTION

This invention relates to an Fe-B-R type rare earth permanent magnet having high magnetic properties. (In the present invention, R represents the rare earth elements inclusive of Y) More particularly, it is concerned with a permanent magnet based on rare earth element (R), boron (B) and iron (Fe), with its corrosion resistant property being improved significantly by the particular compositional ratios of the constituent elements.

There was previously proposed by three of the present inventors, as an improved permanent magnet of high performance which exceeded the highest magnetic properties of the conventional rare earth-cobalt magnet, an Fe-B-R type permanent magnet which was composed of as the principal components iron (Fe), boron (B) and light rare earth elements such as neodymium (Nd) and praseodymium (Pr) abundantly available in the natural resources, but not using samarium (Sm) and cobalt (Co) which are scarcely available in the natural resources or uncertain in the commercial availability, hence expensive (Japanese Patent Kokai Publications No. 59-46008 and No. 59-89401 or EPA 101552).

Said inventors also succeeded in obtaining another Fe-B-R type permanent magnet having a higher range of the Curie temperature than that of the abovementioned magnetic alloy which ranges, in general, from 300° C. to 370° C., by substituting cobalt (Co) for a part of iron (Fe) (Japanese Patent Kokai Publications No. 59-64733 and No. 59-132104 or EPA 106948).

With a view to improving the temperature characteristics (in particular the coercivity "iHc"), while retaining the Curie temperature equal to, or higher than that, and a higher (BH)max than that, of the above-mentioned Co-containing Fe-B-R type (i.e., more precisely (Fe,Co)-B-R type) rate earth permanent magnet, use said inventors further proposed still another Co-containing Fe-B-R type rare earth permanent magnet with much more improved iHc, while still retaining a very high (BH)max of 25 MGOe or above, which could be realized by including at least one kind of heavy rare earth elements such as dysprosium (Dy), terbium (Tb), etc. as a part of R of the Co-containing Fe-B-R type rare earth permanent magnet, R mainly containing light rare earth elements such as Nd and/or Pr (Japanese Patent Kokai Publication No. 60-34005 or EPA).

However, the permanent magnets having the abovementioned excellent magnetic properties and being composed of the Fe-B-R type magnetically anisotropic sintered body contain, as its principal constituents, those rare earth elements and iron which are apt to be oxidized in the air and tend to gradually form stable oxides. On account of this, when such permanent magnet is assembled in the magnetic circuit, various problems and inconveniences would be brought about by the oxides formed on the surface of the magnet: such as decrease in output of the magnetic circuit; irregular functioning among the magnetic circuits; and, in other aspect, contamination of various peripheral devices around the magnetic circuits due to scaling off of the resultant oxides from the surface of the magnet.

In order therefore to improve the corrosion resistant property of the abovementioned Fe-B-R type permanent magnet, there was already proposed a permanent magnet with an anti-corrosive metal layer having been plated on its surface by the electroless plating method or the electrolytic plating method (Japanese Patent Application No. 58-162350), and another permanent magnet with an anti-corrosive resin layer having been coated on its surface by the spraying method or the dipping method (Japanese Patent Application No. 58-171990).

With this plating method, however, there still remained problem such that, since the permanent magnet is a sintered, somewhat porous body, an acidic or alkaline solution used for its pre-treatment before the plating procedure stays in the pores of the sintered magnet body, which is apprehensively liable to corrode the magnet with lapse of time; and further, since the magnet body is inferior in its chemical-resistant property, the surface of the magnet is corroded during the plating procedure to deteriorate its adhesion property and corrosion-resistant property.

Further, as to the latter spraying method, since the resin coating by this method has directionality, a great deal of working steps and time are required for applying the uniform resin coating over the entire surface of the workpiece to be treated; in particular, coating of a magnetic body having a complicated configuration with the coating film of a uniform thickness is all the more difficult. Furthermore, with the dipping method, thickness of the resin coating becomes non-uniform with the consequence that the finished product has a poor dimensional precision.

Furthermore, as the Fe-B-R type permanent magnet which could successfully solve the disadvantages inherent in the abovementioned plating method, spraying method and dipping method, and provide stabilized corrosion resistant property over a long period of time, there were also proposed improved permanent magnets provided on its surface with a vapor-deposited corrosion-resistant layer composed of various metals or alloys (Japanese Patent Applications No. 59-278489, No. 60-7949, No. 60-7950 and No. 60-7951, now corresponding EPA 0190461). By this vapor-deposition method, oxidation of the surface of the magnet body is suppressed, so that the magnetic property is prevented from deterioration. Also, since there is no necessity for use of corrosive chemicals, etc., hence no apprehension whatsoever of its remaining in the magnet body as it the case with the plating method, the permanent magnet as treated by this method is capable of retaining its stability over a long period of time.

While the vapor-deposition method is highly effective for improvement in the corrosion resistance of the permanent magnet, it has its own disadvantage such that a special treating apparatus is required, and its productivity is low, so that the treatment by this method is considerably expensive.

U.S. Pat. No. 4,588,439 discloses an Fe-B-R type permanent magnet alloy containing 6,000 to 35,000 ppm, (preferably 9,000 to 30,000 ppm) oxygen in order to avoid disintegration of the sintered body based on an autoclave test. However, this alloy consumes much rare earth elements as oxides. For complete suppression 9,000 ppm oxygen is necessary. Namely rare earth elements of 6 times by weight of the oxygen amount is consumed to form oxides. Such large amount of oxide is not preferred since the presence of nonmagnetic oxides adversely affects the magnetic properties, and valuable rare earth elements are consumed. For instances, 10,000 ppm oxygen will consume 6% by weight of rare earth elements as oxides.

SUMMARY OF THE DISCLOSURE

Thus these is much to be desired in the art. Stillmore, the producing procedure and raw materials and intermediate products must be carefully handled to avoid oxidation, which further leads to an increase in the production costs.

It is therefor an object of the present invention to provide an Fe-B-R type permanent magnet material having improved corrosion resistant property.

It is another object of the present invention to provide an Fe-B-R type permanent magnet capable of exhibiting its excellent corrosion resistant property, not by its surface treatment for improving the corrosion resistant property thereof, but by specifying its composition.

it is still another object of the present invention to provide an Fe-B-R type permanent magnet having excellent durability, while maintaining its high magnetic property.

It is a further object of the present invention to provide an Fe-B-R type permanent magnet having higher temperature characteristic.

Still further objects will become apparent in the entire disclosure.

The present invention is based on the finding, as the result of conducting various studies and researches on the compositional aspects of the Fe-B-R type permanent magnet, that, by specifying Nd and Dy as the rare earth element (R), and by defining specific amounts of B, Co, Al and Fe and specific limitation of the amount of C in the magnet (or material) composition, improvement in the corrosion resistance of the permanent magnet (or material) could be attained without deteriorating its magnetic properties, which improvement was so significant that could not be realized with the conventional permanent magnets. Further improvement may be achieved by including Ti and/or Nb in specific amounts.

That is to say, according to the present invention, in general aspect thereof, there is provided on (Fe,Co)-B-R tetragonal type rare earth magnet (or material) having excellent corrosion resistant property, which consists essentially of: 0.2–3.0 at% Dy and, 12–17 at% of the sum of Nd and Dy; 5–8 at% B, 0.5–13 at% Co.; 0.5–4 at% Al; and the balance being Fe, the principal phase being of the tetragonal structure. Fe should be at least 65 at%, while the sum of Fe and Co is, preferably, at least 75 at%.

The foregoing objects, other objects and the specific composition of the (Fe,CO)-B-R type rare earth permanent magnet (or material) according to the present invention will become more apparent and understandable from the following detailed description thereof, with reference to the preferred embodiments of its production and magnetic properties, when read in conjunction with the accompanying drawings.

BRIEF DESCRIPTION OF THE ACCOMPANYING DRAWINGS

DETAILED DESCRIPTION OF PREFERRED EMBODIMENTS

Figure 1:
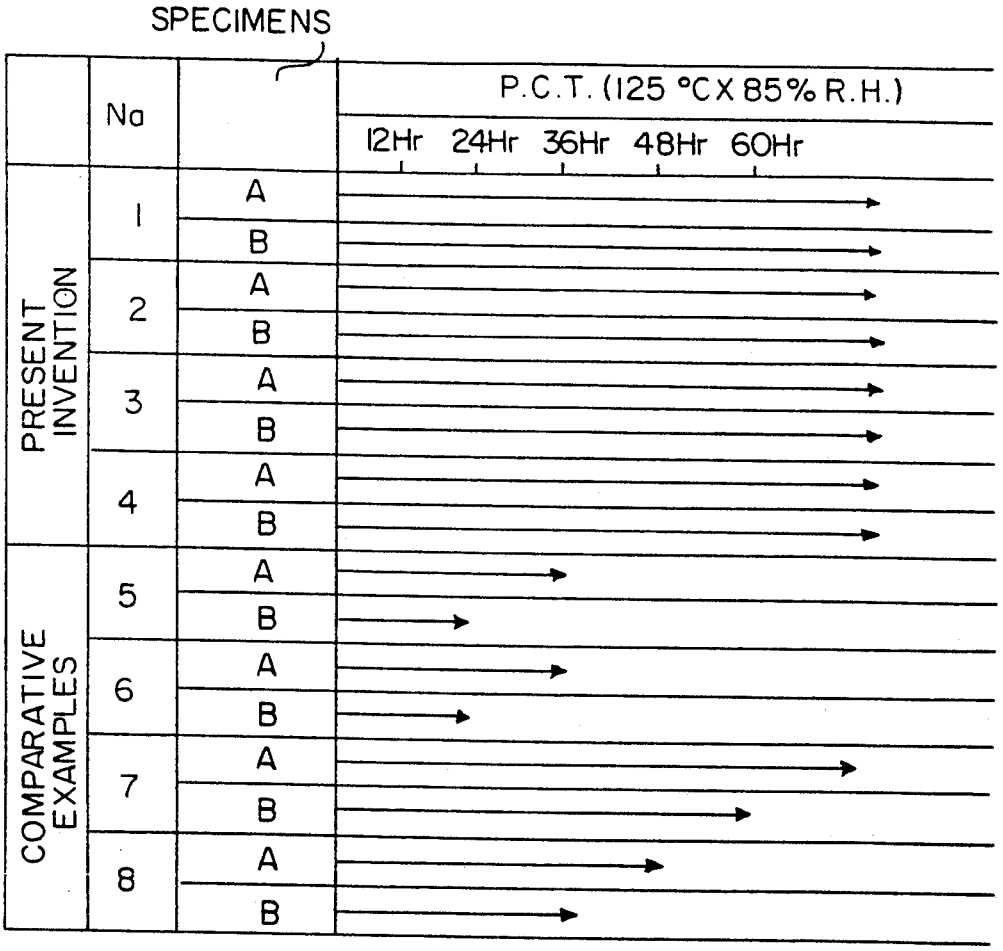
FIG. 1 is a graphical representation of a result of the Pressure Cooker Test, showing the length of time lapsed until the surface coating blistered or the material surface produced oxide powders.

In the following, the present invention will be described in specific detail.

The rare earth permanent magnet material according to the present invention possesses (BH)max of 25 MGOe or above the iHc of 10 kOe or above (when made to an anisotropic sintered magnet), and, as the result of the Pressure Cooker Test (P.C.T.) in an atmosphere of a temperature of 125° C. and a relatively humidity of 85% as well as a prolonged holding test in an atmosphere of a temperature of 80° C. and a relatively humidity of 90%, it exhibits particularly superior corrosion resistant property in comparison with the conventional Fe-B-R type rare earth permanent magnet material which has been subjected to undercoating treatment with aluminum and then to further chromate treatment.

Also, by inclusion of 0.1–1.0 at% of one of Ti and/or Nb in addition to the abovementioned composition, the rare earth permanent magnet according to the present invention is capable of improving its magnetic properties (in particular, its rectangularity in the demagnetization curve) and its (BH)max without deteriorating the excellent corrosion resistant property.

The grain boundary phase in this Fe-B-R type rare earth permanent magnet, in the case where Co and Al are not contained in the alloy, is composed of: an R-rich phase which does not substantially contain B, but a few atomic percents of Fe, and is composed mostly of the rare earth element; and an $R_{1+\epsilon}Fe_4B_4$ phase with a high content of B (about 40 at% or more). On account of this, the deterioration in the corrosion-resistance of the Fe-B-R type rare earth permanent magnet is considered primarily ascribable to the presence of the abovementioned R-rich phase which contains the chemically active rare earth elements as the principal constituent.

In the case of the Fe-B-R type permanent magnet according to the present invention, it is presumed that the Co and Al existing in the grain boundary phase enter into the abovementioned R-rich phase to form a multi-phase which, based on the specific control in quantity of Co and Al, and without impairing the magnetic properties, contributes to significant improvement in the corrosion resistance of the grain boundary phase.

The magnetic properties of the Fe-B-R type magnet (or magnet material) are primarily attributable to the Fe-B-R tetragonal type intermetallic compound expressed in terms of the chemical formula $R_2Fe_{14}B$. Generally, in order to provide a magnetically anisotropic, sintered permanent magnet of the practically high magnetic properties, the magnet composition should be carefully selected within a region where the composition is R-richer and B-richer than the stoichiometric composition of $R_2Fe_{14}B$. (Particularly in a region where R is not sufficient, $\alpha$-iron precipitates in the alloy and/or sintered magnet which causes a ready invertion of magnetization resulting in a low coercivity.)

In the region of the R-rich and B-rich side, an R-rich phase composed almost of metallic R and a B-rich phase expressed by $R_{1+\epsilon}Fe_4B_4$ occur, which serve to improve the sintering characteristics and coercivity, particularly, the R-rich phase smoothes the grain boundary of the tetragonal crystal grains through the sintering (and further aging).

It has been revealed that the corrosion resistance is primarily related with this R-rich boundary phase. The "R" in the R-rich phase is very apt to be oxidized by oxygen and/or moisture in the ambient atmosphere. Further, if carbon (C) and/or chlorine (Cl) are included as impurities, they are present as carbide or chloride of R, which will readily react with moisture in the atmosphere to decompose. (Thus, generally speaking, C and Cl should be maintained at a low level.)

R becomes oxide of R (e.g., $R_2O_3$) which is nonmagnetic and causes the magnetic properties to decrease as the amount of the oxide increase (particularly, Br and (BH)max will gradually decrease). However, if there is still a certain amount of R (i.e., more than that to be present as R-oxide) requisite for sintering to make a magnet. That is, if the amount of R is large, oxygen may be allowed in a correspondingly large amount. However, if the amounts of R and oxygen increases, it results in occurrence of a large amount of the nonmagnetic phase, which leads to lowering in Br and (BH)max. So far as the amount of R is limited (as is usual in the practice), the amount of R will short when a large amount of oxygen is present, which finally results in a complete loss of coercivity.

According to the present invention, such problems ascribable to the oxidation of the R-rich phase (or generally the boundary phase) can be eliminated by incorporation of a certain amount of Co and Al in the composition. Particularly, the ratio of the sum of Co and Al to the amount of rare earth elements (R') contained (or to be contained) in the boundary phase: (Co+Al)/R' is important. By controlling this ratio, the rare earth elements contained in the boundary phase can be stabilized. A considerable amount of Co and Al forms stable intermetallic compounds with R (e.g., $NdCo_3$, $Nd_3Co_7$, etc.; there occur certain compounds containing Al as solid-solution) which contribute to the corrosion resistance.

Note that a certain amount thereof forms the $R_2(Fe,Co)_{14}B$ tetragonal type phase. (It is presumed that some part of Al also assumes the site of Fe in this tetragonal type crystal structure to form $R_2(Fe,Co,Al)_{14}B$.) These compounds have improved corrosion resistance over the base $R_2Fe_{14}B$ phase.

Preferably, (Co+Al)/R' ranges about 0.5 to about 10 (more preferably 0.7 to 5). Below 0.5 the improvement in the corrosion resistance would be not sufficient, while above 10 the sintering characteristics will deteriorate leading to a lowering in iHc.

As a guideline for control, the amount of R' can be roughly calcurated by the following equation:

$$R' \approx \text{total } R - \left(\frac{2}{17}A + \frac{2}{5}RO\right) \text{ (by at \%)}$$

where A is the total amount of the elements contained in the tetragonal type phase and RO is the amount (by at%) of the R-oxide ($R_2O_3$) in the magnet or material.

Measurement, e.g., by X-ray micro-analyzer (XMA) etc. can provide definite figure of R', Co and Al.

By the incorporation of Co and Al, the corrosion resistance not only of the final sintered product but of the alloy material (particularly powder) therefor can be significantly increased. For instance the alloy powder obtained by the direct reduction process from rare earth oxide through a reduction agent, e.g., Ca can reduce the amount of oxygen through the incorporation of Co and Al. Thus the present invention provides significant improvement in the practical, industrial production and utilization of the generally Fe-B-R type permanent magnets.

In the present invention, the reason for limiting the range of content for each of the constituent elements in the rare earth permanent magnet is as follows.

With the content of Dy not reaching 0.2 at %, no increase is seen in both iHC and (BH)max. On the contrary, with its content exceeding 3.0 at%, improvement is seen in iHc. However, since Dy is available only in small quantity in the natural resources, it is very expensive and hence unfavorably pushes up the production cost of the permanent magnet. On account of this, its content is limited to a range of from 0.2 at% to 3.0 at%, or preferably from 0.2 at% to 2.0 at%. Dy also serves to improve the temperature characteristics of the magnet particularly in reversible loss of magnetic flux at a high temperature and irreversible loss of magnetic flux after being subjected thereat.

When the total quantity of Nd and Dy (i.e., the total quantity of the rare earth elements) is below 12 at%, $\alpha$-Fe would precipitate in the metallic compound of the principal phase to abruptly decrease iHc. On the other hand, above 17 at%, the corrosion resistance of the basic Fe-B-R ternary composition is deteriorated due to the occurrence of greater amounts of R-rich phase if a large amount of Co and Al is not present (such large offers problem in the magnetic properties). For these reasons, the total quantity of Nd and Dy is limited to a range of from 12 at% to 17 at%, or preferably from 12.5 at% to 15 at% (for achieving 30 MGOe or more and good corrosion resistance). The amount of Nd is preferably 11–16 at% (more preferably 12–14.5 at%). At least 11 at% Nd is preferred to provide sufficient Nd-rich boundary phase, and generally to save Dy (the latter is applied to also 16 at% Nd). However, Nd may be partly replaced by Pr so far as the magnetic and anticorrosion properties are not affected. Similarly, as a commertially available Nd material, Didymium containing Nd, Pr and Ce may be partly employed.

With the content of B not reaching 5 at%., iHc unfavorably drops down to 10 kO3 or lower. On the other hand, with its content exceeding 10 at%, iHc increases, but Br drops down to become unable to obtain (BH)max of 25 MGOe or higher. Besides, above 10 at% B, the nonmagnetic B-rich phase increases to a considerable amount. For these reasons, the content of B is limited to a range of from 5 at% to 10 at% (preferably 6–8 at%).

Co is effective for increasing the Curie temperature, improving the weather-resistance of the product and the oxidation resistance of the raw material (alloy, particularly its powder), as well as increasing Is. With the Co content below 0.5 at%, the effect of increasing the Curie temperature and improving the corrosion resistance of the product (or material) is small. On the contrary, with its content exceeding 13 at%, Co is locally concentrated to be agglomerated in the grain boundary at a high density with the consequence that a ferromagnetic R(Nd,Dy)-Co compound containing therein 30 at% or more of Co is precipitated to readily bring about reversal of magnetization in the Fe-B-R type rare earth permanent magnet of the present invention, resulting in a lowered iHc. For these reasons, the content of Co is limited to a range of from 0.5 at% to 13 at%, or preferably from 1 at% to 10 at% in view of these aspects. Besides, at 5 at% Co or more, the temperature coefficient of Br is 0.1 %/°C. or less.

Al is effective for increasing iHc and, in particular, improving the corrosion resistance of the product in cooperation with Co by synergic effect therewith. It has an effect of improving iHc which tends to decrease with increase in the adding quantity of Co. With the Al content below 0.5 at%, the effect of increasing iHc and improving the corrosion resistance of the product (or material) is not satisfactory. On the contrary, with its content exceeding 5 at%, the effect is seen in the improved iHc, but Br lowers and (BH)max lowers below 25 MGOe. In balancing these, the content of Al is limited to a range of from 0.5 at% to 5 at%, or preferably from 0.5 at% to 3 at%.

Ti or Nb has an effect of compensating for the decrease in Br and (BH)max due to addition of Al. With the content of Ti or Nb not reaching 0.1 at%, no sufficient effect of increasing Br is recognized. On the other hand, with the content thereof exceeding 1.0 at%, Ti or Nb is combined with B in the magnetic alloy to form borides of Ti or Nb, which invites decrease (thus short) in B necessary for the magnetic alloy, entailing, at the same time, decrease in iHc. For these reasons, the content of Ti and/or Nb is limited to a range of from 0.1 at% to 1.0 at%, or preferably from 0.2 at% to 0.7 at%. V, Mo, W, Ta, Hf and Zr may be present each in an amount 0.1–1.0 at%, which serve like Ti or Nb.

C gives also great influence on the corrosion-resistance of the permanent magnet. C may be contained as carbide of R which will readily react with moisture in the atmosphere to be caused to decompose. When its content exceeds 2,000 ppm, the corrosion resistance abruptly decreases, which entails difficulty in obtaining a practical permanent magnet. Therefore, its content should be 2,000 ppm or below, or preferably 1,000 ppm or below, or more preferably 700 ppm or below. C tends to come from the starting materials such as iron, ferro-boron or rare earth elements as an impurity, or sometimes through the production process (e.g., from organic compacting aids or when solvents are used for pulverization etc.).

In the rare earth permanent magnet or alloy material according to the present invention, the remainder of the composition other than the abovementioned elements is Fe and unavoidable impurities.

Fe should be present at least 65 at% since below this amount, it is difficult to achieve 25 MGOe or more. Fe is preferably at most 81 at% since above this, α-iron tends to precipitate. Thus Fe of 68–81 at% is more preferred. It should be noted that Co may replace some part of the Fe site in the basic Fe-B-R tetragonal type crystal structure to form the (Fe,Co)-B-R tetragonal type crystal structure.

Oxygen is generally not preferred since valuable R is consumed as oxide which is nonmagnetic. Oxygen is believed to be present almost as R-oxide (e.g., $R_2O_3$) in the magnet after sintering at 1,000° C. or higher since R is chemically active. However, oxygen is inevitably contained as the impurity because rare earth elements are generally very apt to be oxidized by oxygen or $H_2O$, and it is not easy to maintain the raw materials, production process, and intermediate and final products free from oxygen or moisture (i.e., air). Therefore the oxygen content should be maintained as low as possible in the sense of the practically or industrially achievable level in light of the magnetic properties and saving (or efficiency) of R. Thus oxygen should be kept at 10,000 ppm or below, or preferably 8,000 ppm or below (more preferably 6,000 ppm or below).

Further impurities may possibly be P, S, Mn, Ni, Si, Cu, Cr and so on, which might be unavoidably mixed into the alloy components in the course of the industrial production. Such impurities are allowed to be present in the magnet or material of the present invention so far as the requisite properties are satisfied.

Chlorine (Cl) may be contained as an impurity, too, e.g., when the pulverization of alloy is effected by wet pulverization using a solvent of organic chlorine compound (trichlorethylene etc.). Then chlorine is contained as chloride of R which will be readily decomposed by moisture in the air. Thus chlorine should be, if contained, if contained in the composition, restricted to, 1,500 ppm or less, preferably, 1,000 ppm or less.

Nitrogen might be incorporated through the production process, e.g., jet milling using $N_2$ as a pulverization medium amounting to about 1,000 ppm while wet-milling by a ball mill using a solvent provides very low amount of nitrogen, e.g., below 100 ppm. If nitrogen is present in the magnet, it may form Nd-nitride which is, very apt to react with $H_2O$. Therefore it is preferred to control it to 2,000 ppm or below, more preferably 1,000 ppm or below.

According to a preferred aspect of the present invention, there is provided magnet consisting essentially of: 12 to 14.5 at% of Nd; 0.2 to 2.0 at% of Dy (the total quantity of Nd and Dy being in a range of from 12.5 to 15 at%); 6 to 8 at% of B; 1 to 10 at% of Co; 0.5 to 3 at: 1,000 ppm or below of C; and remainder of Fe (68–81 at%) and unavoidable impurities, wherein the principal phase (preferably at least 85 vol %) is the (Fe,Co)-B-R tetragonal type crystal structure, exhibits excellent magnetic properties of (BH)max and iHc which are 30 MGOe or higher and 13 kOe or higher, respectively, as anisotropic sintered magnets and also exhibits very high corrosion-resistant property.

Note, however, that by applying appropriate aging, the magnet achieves still higher magnetic properties.

Further, the permanent magnet (or material) according to the present invention exhibits its best corrosion resistance when it contains, as the principal phase, $R_2(Fe,Co)_{14}B$ type compound having the tetragonal crystal structure, and has a grain boundary phase which contains from 5 to 30 at% Co and 5 at% or less Al in the R-rich multi-phase. The R-rich multi-phase is composed of an R-rich phase not containing therein Al but Co and another R-rich phase containing therein both Al and Co. When the crystal grain size of the magnet is about 1 μm–100 μm (pref. 2–30 μm) the magnet provides significantly high magnetic properties.

TABLE 1

| | | Composition (at %) | | | | | | | | C | Oxygen | Within R-rich Phase (at %) | | Magnetic Properties | | |
|---|---|---|---|---|---|---|---|---|---|---|---|---|---|---|---|---|
| | | Fe | Nd | Dy | B | Co | Al | Ti | Nb | (ppm) | (ppm) | Co | Al | Br (kG) | iHc (kOe) | (BH)max MGOe |
| Present Invention | 1 | 67.5 | 14 | 1.5 | 7 | 8 | 2 | — | — | 800 | 5500 | 22–29 | 0.5–1.5 | 11.4 | 20 | 31.1 |
| | 2 | 70.5 | 14 | 0.5 | 7 | 6 | 2 | — | — | 650 | 6200 | 15–29 | 0.4–1.2 | 12.1 | 16.0 | 36.0 |
| | 3 | 69.5 | 14 | 0.5 | 7 | 6 | 2 | 1 | — | 270 | 3100 | 5–25 | 0.4–1.5 | 12.5 | 14.8 | 36.2 |
| | 4 | 73 | 14 | 0.5 | 7 | 4 | 1 | — | 0.5 | 430 | 4800 | 5–23 | 0.3–1.0 | 12.4 | 15.2 | 36.4 |
| Comparative Example | 5 | 77.5 | 14 | 1.5 | 7 | — | — | — | — | 800 | 7500 | 0 | 0 | 11.5 | 19.4 | 32.0 |
| | 6 | 78 | 14 | 0.5 | 7 | — | — | — | 0.5 | 1200 | 5300 | 0 | 0 | 12.3 | 15.8 | 36.0 |
| | 7 | 72.5 | 14 | 0.5 | 7 | 6 | — | — | — | 1100 | 3800 | 0–28 | 0 | 12.6 | 10.5 | 37.0 |
| | 8 | 77.5 | 14 | 0.5 | 7 | — | 1 | — | — | 700 | 4400 | 0 | 0 | 12.5 | 15.4 | 35.2 |

With a view to enabling those persons skilled in the art to put the present invention into practice, the following preferred examples are presented.

EXAMPLES

Example 1

As the starting material, use was made of electrolytic iron of 99.9% purity (by weight as to the purity); ferro-boron alloy (20% b); Nd (>97% the balance being Pr); Dy, Co, Al and Ti of >99%; ferro-niobium containing 67% Nb; After these ingredients were mixed at their various predetermined ratios, each mixture was molten to form an alloy under high frequency heating, after which the molten alloy was cast in a water-cooled copper mold. As the result, there were obtained alloy ingots of various compositions as shown in Table 1 below. Certain amounts of Si, Mn, Cu and Cr were incorporated originating from the ferro-boron. These elements improve iHc and rectangularity of the demagnetization curves, which seems to be based on the presence of 300–5,000 ppm Si and 200–3,000 ppm in total of Mn, Cu and Cr in the magnet.

Thereafter, the ingot was crushed coarsely by a stamping mill, followed by wet pulverization in a ball mill using trichloro-trifluoroethane, thereby obtaining pulverized powders having an average particle size of 3 μm.

Each of the pulverized powders was then charged in a metal mold of a pressing device, subjected to alignment in a magnetic field of 12 kOe, and compacted under a pressure of 1.5 tons/cm$^2$ in the direction perpendicular to the magnetic field. The resultant compact was then sintered at a temperature ranging from 1,040° C. to 1,120° C. for two hours in an argon atmosphere, after which it was allowed to cool. Thereafter, the sintered body was further subjected to aging treatment at 600° C. As the result, there were obtained the permanent magnet material specimens having a dimension of 20 mm×10 mm×8 mm, which were magnetized by applying a magnetic field of at least 25 kOe.

The magnetic properties of the thus obtained permanent magnets were measured, the results being shown in Table 1 below. The quantity of Co and Al were determined by use of an X-ray micro-analyzer, wherein the compositional analyses of the R-rich phase in the grain boundary were carried out. The evaluation of the analyses was given in terms of the average values of the compositions in the grain boundary phase primarily at the triple points.

The magnetic properties were measured after the magnetization. As is apparent from Table 1, the Fe-B-R type permanent magnet having the composition as specified in this invention possesses magnetic properties which are equal to, or higher than, that of the conventional Fe-B-R type permanent magnet.

EXAMPLE 2

Some of the test specimens obtained from Example 1 above were subjected to the undercoating treatment with Al followed by surface-treatment with chromate to provide surface-treated specimens; and, on the other hand, the remainder wee left untreated as the surface-untreated precimens. Each group of the specimens was then subjected to the Pressure Cooker Test (P.C.T.) in an atmosphere of a relative humidity of 85% at a temperature of 125° C. under a pressure of 2 kgf/cm$^2$. Through the P.C.T. tetragonal grains will be isolated from the surface of the specimen through the corrosion of the boundary phase to produce a grey colored powder. Thus the P.C.T. represents the evaluation of the corrosion resistance primarily due to the stabilization of the boundary phase.

The test result was evaluated by the length of time taken until the surface-treated film peeled off the surface of the specimen to bring about blisters, or the length of time lapsed until the surface of the specimen material produced powder. FIG. 1 indicates the test results.

As is apparent from FIG. 1, the permanents magnets according to the present invention which are in a state as produced and have not undergone any surface-treatment exhibit particularly excellent corrosion resistance in comparison with that of the conventional permanent magnets which were subjected to the surface-treatment for improving the corrosion-resistance. The specimens which did not suffer disintegration exhibited almost the same magnetic properties as those before testing while those of the disintegrated specimens were not measured.

EXAMPLE 3

Figure 2:
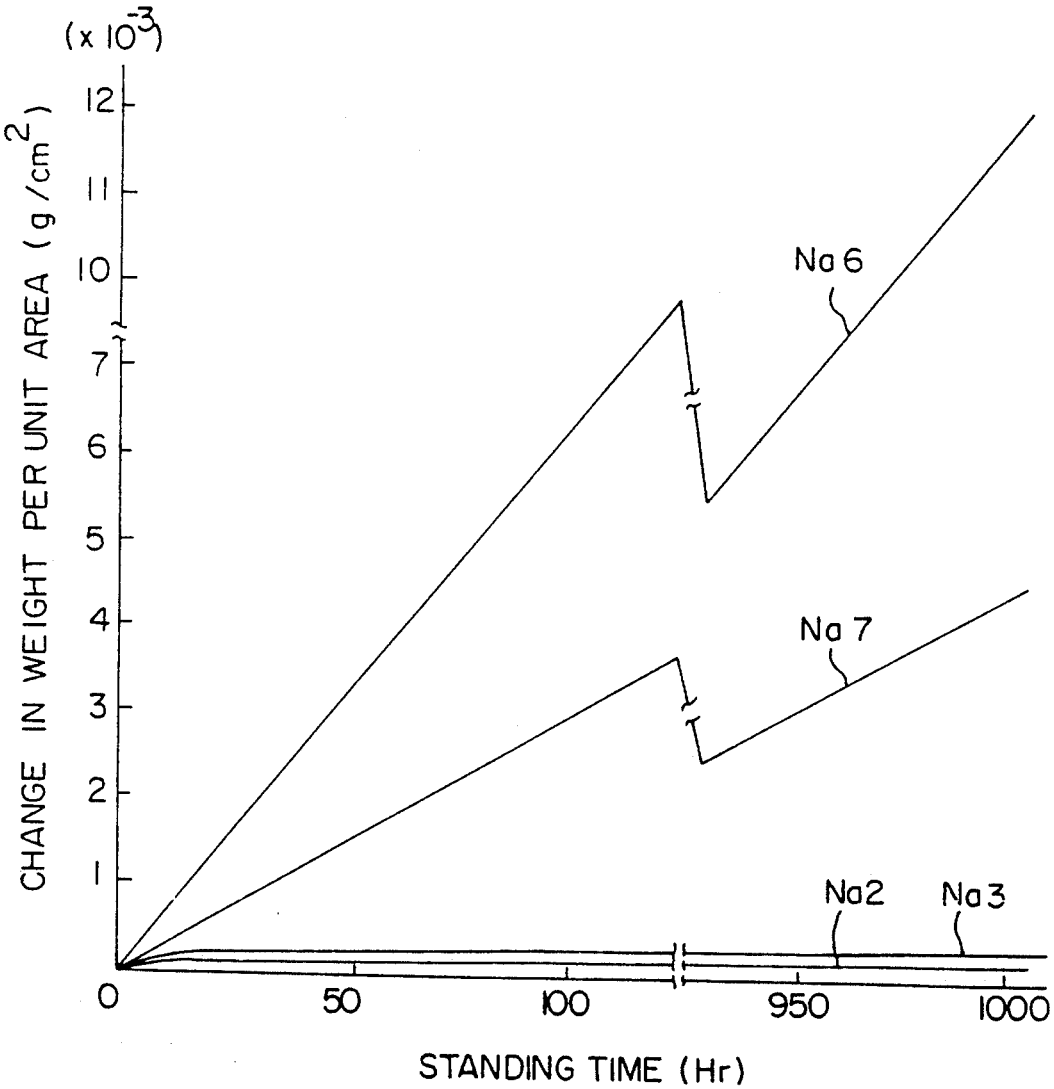
FIG. 2 is a graphical representation of a result of the corrosion-resistance test, showing a relationship between the standing time and variations in weight of the samples per unit surface area.

The test specimens Nos. 2, 3, 6 and 7 in Table 1 as obtained from Example 1 above and not subjected to the surface-treatment were subjected to the corrosion-resistance test, in which the specimens were held in an atmosphere of a relatively humidity of 90% at temperature of 80° C. over a long period of time (accelerated weather-proof test). The test result was evaluated by increase in quantity of the oxide per unit surface area of each specimen versus the length of time, during which the specimen was held in the abovementioned atmosphere. The test results are shown in FIG. 2. The resultant specimens after this test produce red rust. Thus this test is an acceleration test representing the weather proofness (or oxidation resistance) of the magnet surface under the usual conditions of use thereof. Namely, the corrosion resistance of the tetragonal grains as well as the boundary phase of the magnet surface is evaluated by this test. Therefore it is necessary to apply also this test for complete evaluation of the corrosion resistance of this type of magnets.

As is apparent from FIG. 2, the permanent magnet according to the present invention has a significantly superior corrosion resistance of such a degree that could not be attained by the conventional Fe-B-R type rare earth permanent magnet.

Example 4

Specimens having no surface treatment were prepared based on the compositions as shown in Table 2 and pulverization was carried out by jet-milling in $N_2$ gas containing 1,000 ppm oxygen, otherwise in the same manner as Example 1. In Table 2 Specimens 12–14 did not include Co and Al. These specimens were tested by an autoclave under a saturated steam atmosphere at 180° C. for 16 hrs for the corrosion resistance. The magnetic properties were measured before and after the corrosion resistance test, while those before the test are shown in Table 3. The loss in weight of the specimens versus the lapse of time was measured, too, and is shown in Table 3.

As apparent in Tables 2 and 3, specimen Nos. 9–11 which include Co and Al did not suffer the loss in weight nor disintegrated, whereas specimen Nos 12–14 were classified in two groups depending upon the total amount of rare earth elements, one group suffering loss and disintegration on the surface portion and the other not.

The specimens which did not suffer disintegration demonstrated the same level of the magnetic properties within the measurement error even after the test in the autoclave.

Accordingly it is concluded that the corrosion resistance of the Fe-B-R type magnets can be significantly improved by incorporating specific amounts of Co and Al. Furthermore, the corrosion resistance of the Fe-B-R type magnets is greatly affected by the total amount of rare earth elements in the magnet or material. Generally, the amount of the rare earth elements which are present in the boundary phase of the Fe-B-R type magnets will increase as the total amount of R increases. Such abundant or excess presence of R adversely affects the corrosion resistance, which, however, can be completely eliminated by the incorporation of Co and Al. Co and Al are believed to stabilize the boundary phase. It was further confirmed that the copresence of Co and Al has an effect to reduce the amount of N in the sintered magnet to a half to a third of that in the base magnet not including Co and Al.

It is also concluded that even when Co and Al are not included, the Fe-B-R type magnet does not suffer disintegration if the total amount of R does not exceed about 14 at% (and the level of C is low). This is believed to be attributable to the non-presence of the abundant R-rich phase in the boundary phase.

Furthermore, the absolute amount of oxygen appears to be not definitive for the corrosion resistance (or disintegration), not only in the case where Co and Al are included but in the case where these are not included. Rather, the definitive factor for suppressing the corrosion is the control of the boundary phase either by stabilizing it by Co and Al or by eliminating the presence of excess R-rich boundary phase, i.e., more than the minimum amount necessary to achieve the requisite high magnetic properties. In light of this aspect, an Fe-B-R type magnet composition containing 14 at% or less R in total in conjunction with the allowable level of impurity (particularly C etc.) will also provide a stable base composition. (Note, however, the presence of Co and Al further stabilize the base composition even as the material.)

TABLE 2

| No. | Composition (at %) Nd | Dy | Fe | B | Co | Al | Oxygen (ppm) | C (ppm) |
|---|---|---|---|---|---|---|---|---|
| 9 | 15.5 | 0.5 | 69 | 7 | 6 | 2 | 6800 | 170 |
| 10 | 14.5 | 0.5 | 70 | 7 | 6 | 2 | 5500 | 220 |
| 11 | 13.5 | 0.5 | 71 | 7 | 6 | 2 | 5200 | 190 |
| 12 | 15.5 | 0.5 | 77 | 7 | — | — | 7200 | 240 |
| 13 | 14.5 | 0.5 | 78 | 7 | — | — | 6400 | 220 |
| 14 | 13.5 | 0.5 | 79 | 7 | — | — | 5500 | 180 |

TABLE 3

| | Br | iHc | (BH)max | loss in weight (%) |
|---|---|---|---|---|
| 9 | 11.9 | 17.1 | 34.2 | 0 |
| 10 | 12.1 | 16.5 | 35.7 | 0 |
| 11 | 12.5 | 15.7 | 36.9 | 0 |
| 12 | 12.0 | 14.1 | 34.9 | 17% |
| 13 | 12.5 | 12.8 | 37.6 | 1% |
| 14 | 12.7 | 9.1 | 37.2 | 0 |

EXAMPLE 5

Based on the composition as shown in Table 4 and otherwise in the same manner as in Example 1 magnet specimens were produced and measured for the amounts of oxygen and carbon and the magnetic properties to be shown in Table 4. The specimens were tested in an atmosphere of a 90% relatively humidity (R.H.) at 80° C. and measured for the change in weight per unit surface of the specimen. The result is shown in FIGS. 3–6.

Figure 3:
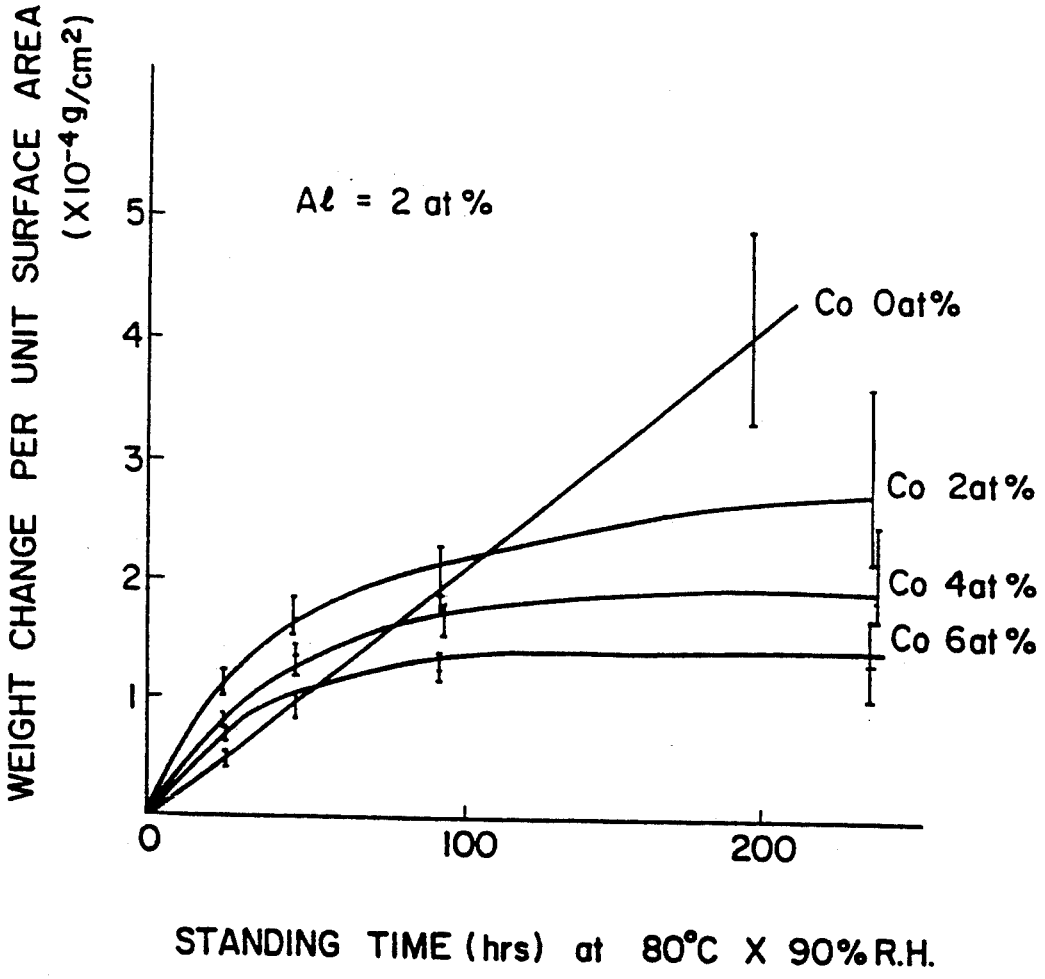
FIGS. 3 and 4 are graphs showing the effect of Co addition where Al is 2 and 0 at%, respectively, in weight change per unit surface area versus standing time at 80° C.×90% R.H.

FIG. 3 represents the change in weight in the case were 2 at% Al is present and the Co amount is changed from 0–6 at%. When Co is not present, the according rate expressed in terms of the change rate in weight is large, whereas the corroding rate becomes to an extremely low level after the lapse of a certain period of time as the Co amount increases.

Figure 4:
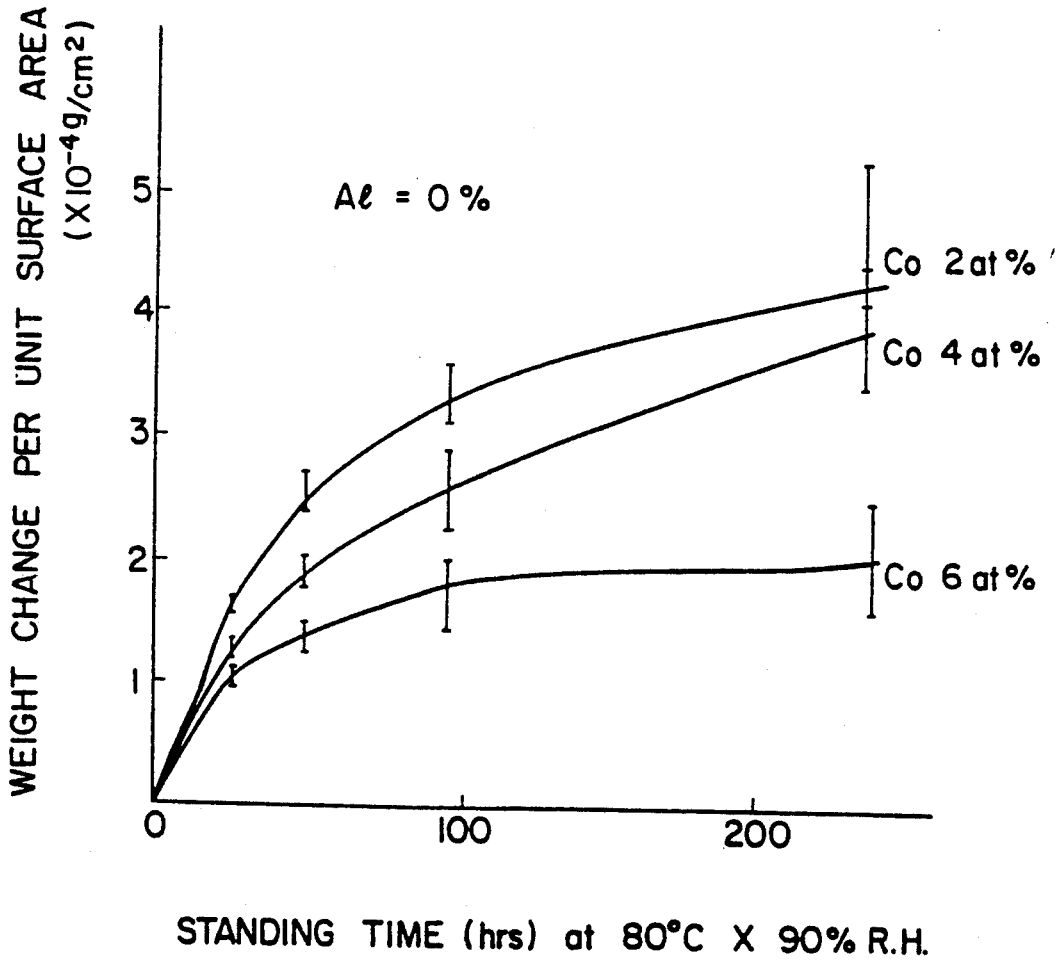
Figure 5:
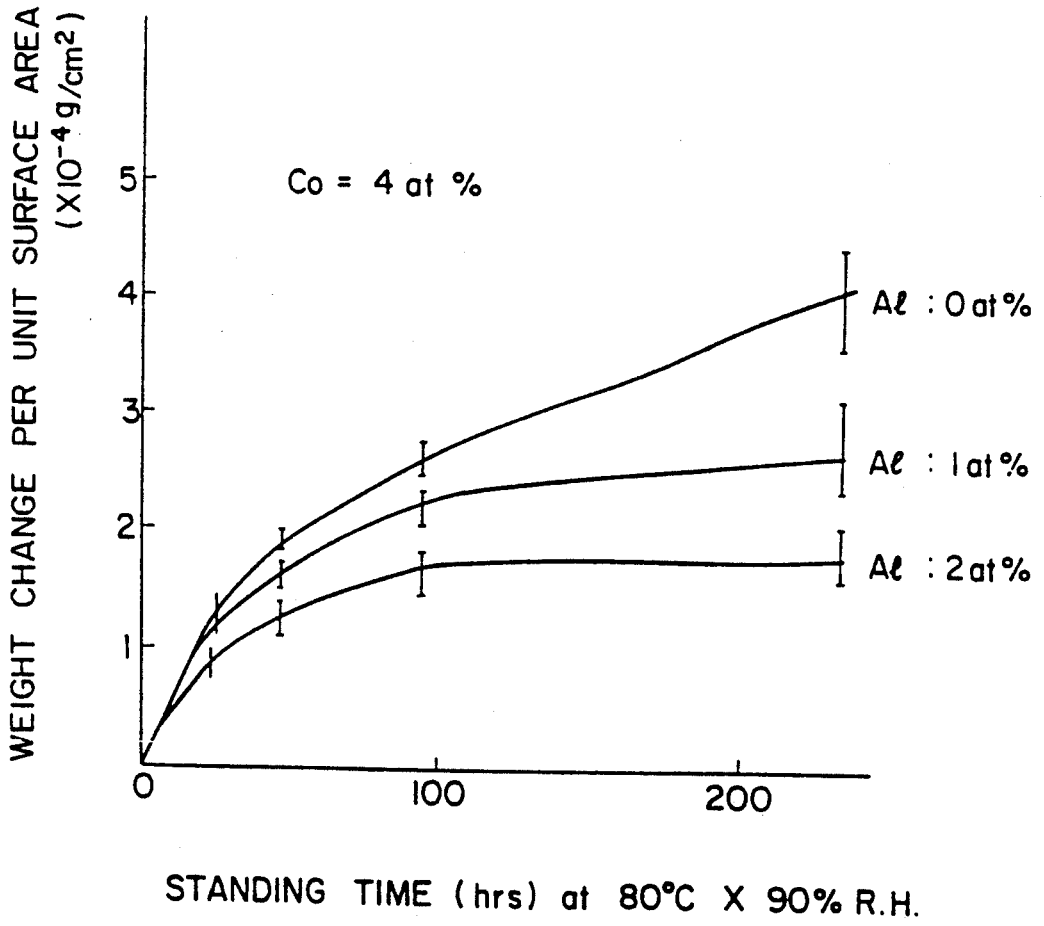
FIGS. 5 and 6 are graphs showing the effect of Al addition where Co is 4 and 0 at%, respectively, in weight change per unit surface area versus standing time at 80° C.×90% R.H.
Figure 6:
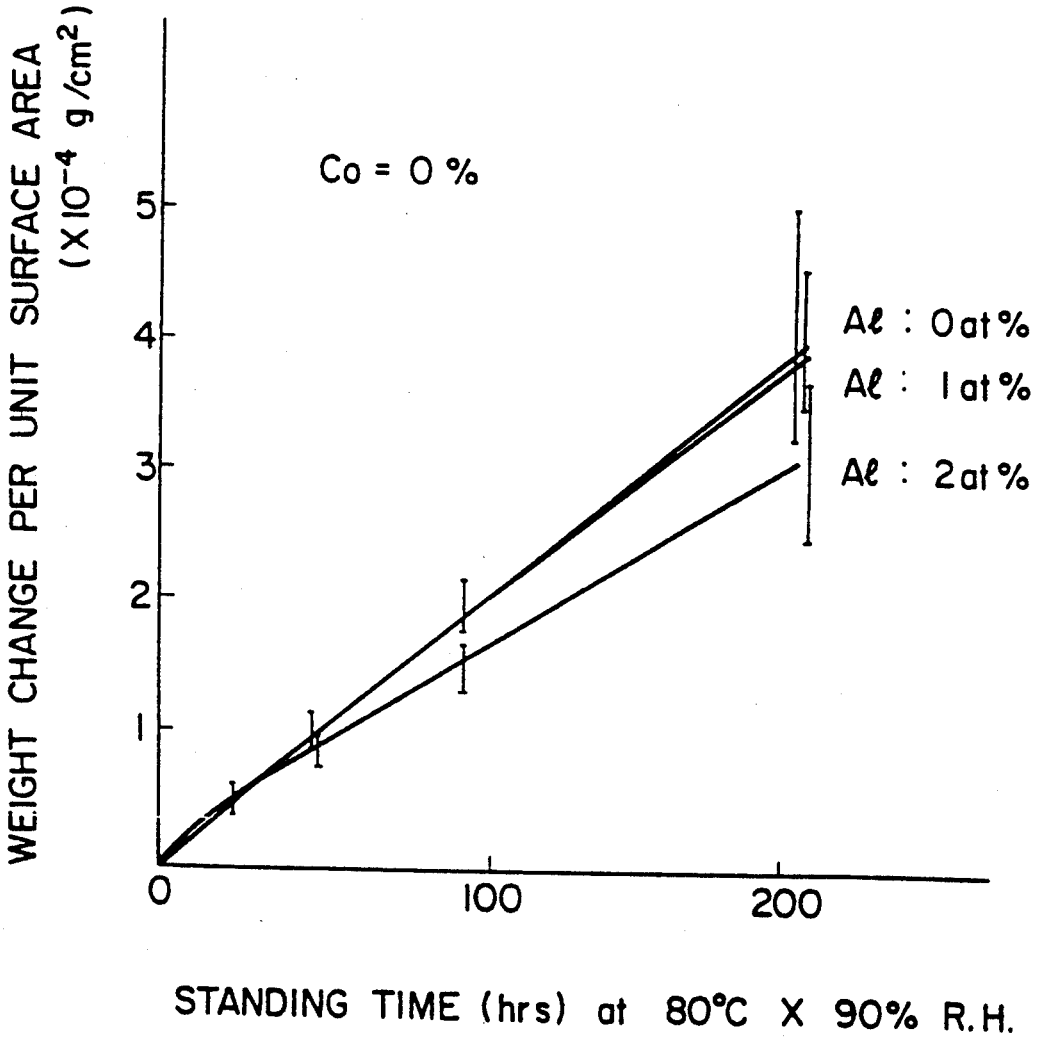

FIG. 4 represents the change in weight in the case where Al is not present and the Co amount is changed from 2 to 6 at%. The changing rate in weight decreases with the lapse of time while the decreasing tendency enhances with increase in the Co amount. In comparison to FIG. 3, FIG. 4 where Al is not present demonstrates greater change (increase) in weight than those in FIG. 3. Such tendency is more significant in FIGS. 5 and 6. Namely, FIGS. 5 and 6 represent the effect of Al at a Co amount of 4 at% and 0% (not included). When Co is not included (FIG. 6), not remarkable effect on the weight change test is achieved by incorporating Al, where as when Co is included (FIG. 5) the magnitude of the change in weight diminishes with increase in the Al amount. Based on this fact it has turned out that the presence of Al contributes to the improvement in the corrosion resistance.

Furthermore, based on the results of Table 4, iHc is significantly improved when a small amount of Al (e.g., 1 at%) is contained, although iHc tends to decrease with increase of Co when Al is not present.

As discussed hereinabove, the synergic effect of the copresence of Co and Al in the Fe-B-R type magnets is significant in improving the corrosion resistance as well as in providing high magnetic properties.

Example 6

Based on ingots having the compositions of Nos. 15 and 17 of Table 4, specimens containing different amounts of C were prepared as follows; (1) jet-milling the ingot using $N_2$-gas as a pulverizing medium (or carrier), (2) fine pulverization by a ball-mill using a solvent (organic fluorine solvent, e.g., flon) as pulverizing medium, and/or (3) to certain specimens admixing a paraffine was to adjust the C amount.

The results including the measured magnetic properties are shown in Table 5. The specimens were further magnetized by application of an external magnetic field of at least 25 kOe and thereafter tested for the weather corrosion resistance in an atmosphere of 90% R.H. at 80° C. to measure the change in the magnetic flux by using a flux meter. The results are shown in FIG. 7.

Figure 7:
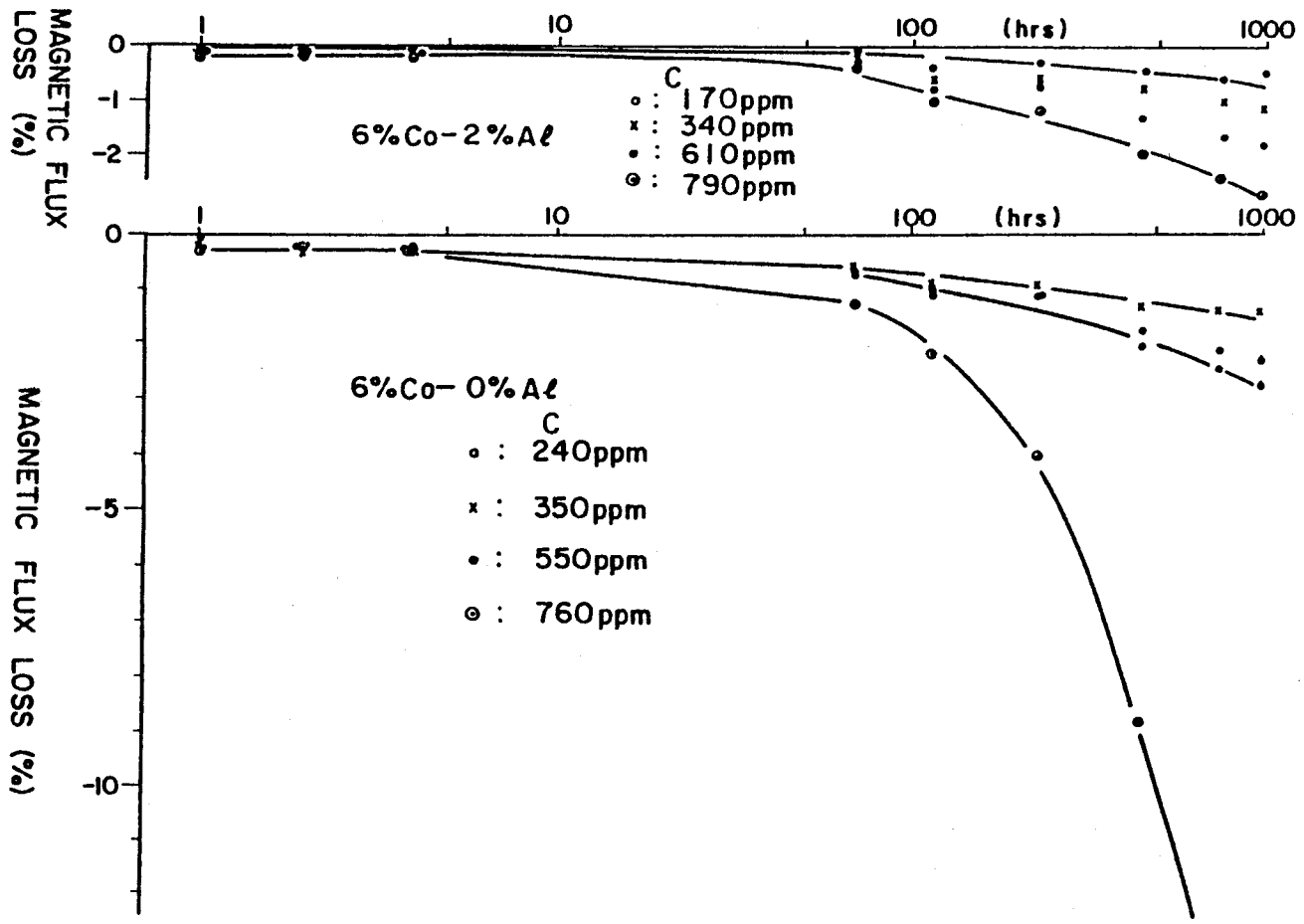
FIG. 7 is graphs showing the effect of Co and Al at different amounts of C in magnetic flux loss versus standing time in a testing atmosphere of 80° C.×90% R.H.

As is apparent in FIG. 7, the flux loss generally increases with increase in C, however, the rate of flux loss significantly diminishes at the presence of Al even when C increases, particularly at about 500 ppm C or more.

As is apparent from the Examples, the present invention can eliminate the surface treatment for improving the corrosion resistance. A further surface treatment may be applied, too. However the surface treatment can be quite simplified in order to given a complete corrosion protection, e.g., resin impregnation with epoxy or the like resin will be sufficient.

So far, the present invention has been described with reference to particular embodiments thereof. It should, however, be noted that changes and modifications may be made by those persons skilled in the art within the gist of the present invention or scope of the present invention as recited in the appended claims.

What is claimed is:

1. A process for producing an (Fe, Co)-B-R tetragonal type magnet having high corrosion resistance wherein R is a rare earth metal and which has a boundary phase stabilized by Co and Al against corrosion, comprising:

providing an ingot of an alloy consisting essentially of 12–14.5 at% Nd and 0.2–3.0 at % Dy, so that the sum of Nd and Dy is 12.5–15 at%;

6–8 at %B;

0.5–8 at % Co;

0.5–3 at % Al; and not exceeding 1000 ppm C; and the balance being at least 68 at % Fe, pulverizing said ingot to a powder by wet milling using an organic compound containing chlorine as solvent under the condition that the resultant powder does not contain Cl in an amount exceeding 15000 ppm, and sintering the powder under the conditions that the resultant sintered body does not include C in an amount exceeding 1000 ppm or Cl in an amount exceeding 1500 ppm in the sintered body to provide a boundary phase stabilized by Co and Al against corrosion.

2. The process as defined in claim 1, wherein the pulverizing and sintering are conducted under conditions that Cl in the sintered body does not exceed 1000 ppm.

3. A process for producing an (Fe, Co)-B-R tetragonal type magnet alloy powder having high corrosion resistance wherein R is a rare earth metal and which has a boundary phase stabilized by Co and Al against corrosion, comprising:

TABLE 4

| | Composition (at %) | | | | | | Impurities (ppm) | | Magnetic Properties | | |
|---|---|---|---|---|---|---|---|---|---|---|---|
| No. | Nd | Dy | Fe | B | Co | Al | Oxygen | C | Br (KG) | (BH)max (MGOe) | iHc (KOe) |
| 15 | 14 | 0.5 | 70.5 | 7 | 6 | 2 | 2400 | 340 | 11.8 | 33.6 | 16.1 |
| 16 | 14 | 0.5 | 71.5 | 7 | 6 | 1 | 2900 | 360 | 12.2 | 35.6 | 14.5 |
| 17 | 14 | 0.5 | 72.5 | 7 | 6 | 0 | 2700 | 330 | 12.6 | 37.7 | 10.1 |
| 18 | 14 | 0.5 | 72.5 | 7 | 4 | 2 | 2700 | 290 | 11.7 | 33.0 | 16.6 |
| 19 | 14 | 0.5 | 73.5 | 7 | 4 | 1 | 2600 | 330 | 12.3 | 36.1 | 14.7 |
| 20 | 14 | 0.5 | 74.5 | 7 | 4 | 0 | 2900 | 300 | 12.7 | 38.1 | 12.1 |
| 21 | 14 | 0.5 | 74.5 | 7 | 2 | 2 | 2000 | 350 | 11.8 | 33.7 | 16.9 |
| 22 | 14 | 0.5 | 75.5 | 7 | 2 | 1 | 2800 | 350 | 12.4 | 36.6 | 15.1 |
| 23 | 14 | 0.5 | 76.5 | 7 | 2 | 0 | 3300 | 340 | 12.7 | 38.5 | 12.7 |
| 24 | 14 | 0.5 | 76.5 | 7 | 0 | 2 | 3000 | 330 | 12.0 | 34.2 | 17.2 |
| 25 | 14 | 0.5 | 77.5 | 7 | 0 | 1 | 2900 | 350 | 12.3 | 36.1 | 16.2 |
| 26 | 14 | 0.5 | 78.5 | 7 | 0 | 0 | 3300 | 350 | 12.7 | 38.7 | 14.2 |

TABLE 5

| | Composition (at %) | | | | | | Impurities (ppm) | | Magnetic Properties | | |
|---|---|---|---|---|---|---|---|---|---|---|---|
| No. | Nd | Dy | Fe | B | Co | Al | Oxygen | C | Br (KG) | (BH)max (MGOe) | iHc (KOe) |
| 27 | 14 | 0.5 | 70.5 | 7 | 6 | 2 | 6500 | 170 | 12.1 | 34.9 | 16.3 |
| 28 | 14 | 0.5 | 70.5 | 7 | 6 | 2 | 2000 | 340 | 12.0 | 34.3 | 16.0 |
| 29 | 14 | 0.5 | 70.5 | 7 | 6 | 2 | 3400 | 610 | 12.0 | 34.4 | 15.7 |
| 30 | 14 | 0.5 | 70.5 | 7 | 6 | 2 | 3700 | 790 | 12.0 | 34.8 | 15.4 |
| 31 | 14 | 0.5 | 71.5 | 7 | 6 | 1 | 6000 | 170 | 12.5 | 34.8 | 16.0 |
| 32 | 14 | 0.5 | 71.5 | 7 | 6 | 1 | 2200 | 330 | 12.4 | 36.9 | 13.8 |
| 33 | 14 | 0.5 | 71.5 | 7 | 6 | 1 | 3600 | 620 | 12.5 | 37.3 | 14.0 |
| 34 | 14 | 0.5 | 71.5 | 7 | 6 | 1 | 3400 | 830 | 12.4 | 37.1 | 13.5 |
| 35 | 14 | 0.5 | 72.5 | 7 | 6 | 0 | 5800 | 240 | 12.9 | 39.9 | 11.8 |
| 36 | 14 | 0.5 | 72.5 | 7 | 6 | 0 | 2200 | 350 | 12.8 | 39.0 | 11.2 |
| 37 | 14 | 0.5 | 72.5 | 7 | 6 | 0 | 3700 | 550 | 12.9 | 39.4 | 11.1 |
| 38 | 14 | 0.5 | 72.5 | 7 | 6 | 0 | 3500 | 760 | 12.9 | 39.8 | 10.6 |

providing an ingot of an alloy consisting essentially of 12–14.5 at % Nd and 0.2–3.0 at % Dy, so that the sum of Nd and Dy is 12.5–15 at %;
6–8 at % B;
0.5–8 at % Co;
0.5–3 at % Al;
not exceeding 1000 ppm C; and
the balance being at least 68 at % Fe, and
pulverizing the resultant ingot to a powder by wet milling using an organic compound containing chlorine as solvent under the condition that the resultant powder does not contain Cl in an amount exceeding 1500 ppm to provide a boundary phase stabilized by Co and Al against corrosion.

4. The process as defined in claim 1 or 3, wherein Co is no more than 6 at %.

5. The process as defined in claim 3, wherein the pulverizing is conducted under conditions that Cl in the resultant powder does not exceed 1000 ppm.

6. The process for producing an (Fe, Co)-B-R tetragonal type magnet having high corrosion resistance wherein R is a rare earth metal and which has a boundary phase stabilized by Co and Al against corrosion, comprising;
providing an ingot of an alloy consisting essentially of 12–14.5 at % Nd and 0.2–3.0 at % Dy, so that the sum of Nd and Dy is 12.5–15 at %;
6–8 at B;
0.5–8 at % Co;
0.5–3 at % Al; and
not exceeding 1000 ppm C; and
the balance being at least 68 at % Fe,
pulverizing said ingot to a powder by wet milling in a solvent under the condition that the resultant powder does not contain C in an amount exceeding 1000 ppm or Cl in an amount exceeding 1500 ppm, and
sintering the powder under the conditions that the resultant sintered body does not include C in an amount exceeding 1000 ppm not Cl in an amount exceeding 1500 ppm in the sintered body to provide a boundary phase stabilized by Co and Al against corrosion.

7. The process as defined in claim 1 or 6, wherein the sintering is conducted under the condition that the resultant sintered body contains a rare earth rich multiphase as a grain boundary phase, said rare earth rich multi-phase containing 5 to 30 at % Co and no more than 5 at % Al, and the balance being predominantly rare earth elements Nd and Dy.

8. The process as defined in claim 1 or 6, wherein the sintering is conducted so that the ratio, by atomic percent, of the sum of Co and Al to the amount of rare earth elements contained in the boundary phase is 0.5–10.

9. The process as defined in claim 6, wherein the pulverizing and sintering are conducted under conditions that C in the sintered body does not exceed 700 ppm.

10. A process for producing an (Fe, Co)-B-R tetragonal type magnet having high corrosion resistance wherein R is a rare earth metal and which has a boundary phase stabilizing by Co and Al against corrosion, comprising:
providing an ingot of an alloy consisting essentially of 12–14.5 at % Nd and 0.2–3.0 at % Dy, so that the sum of Nd and Dy is 12.5–15 at %;
6–8 at % B;
0.5–8 at % Co;
0.5–3 at % Al; and
not exceeding 1000 ppm C; and
the balance being at least 68 at % Fe,
pulverizing said ingot to a powder by jet milling in $N_2$ gas under the condition that the resultant powder does not contain N in an amount exceeding 2000 ppm, and
sintering the powder under the conditions that the resultant sintered body does not include C in an amount exceeding 1000 ppm or N in an amount exceeding 2000 ppm in the sintered body to provide a boundary phase stabilized by Co and Al against corrosion.

11. The process as defined in claim 10, wherein the sintering is carried out so that N does not exceed 1000 ppm in the resultant sintered body.

12. The process as defined in claim 10, wherein the pulverizing and sintering are conducted under conditions that N in the sintered body does not exceed 1000 ppm.

13. A process for producing an (Fe, Co)-B-R tetragonal type magnet alloy powder having high corrosion resistance wherein R is a rare earth metal and which has a boundary phase stabilized by Co and Al against corrosion, comprising:
providing an ingot of an alloy consisting essentially of 12–14.5 at% Nd and 0.2–3.0 at % Dy, so that the sum of Nd and Dy is 12.5–15 at %;
6–8 at % B;
0.5–8 at % Co;
0.5–3 at % Al;
not exceeding 1000 ppm C; and
the balance being at least 68 at % Fe, and pulverizing the ingot to a powder by jet milling in $N_2$ gas under the condition that the resultant powder does not contain N in an amount exceeding 2000 ppm to provide a boundary phase stabilized by Co and Al against corrosion.

14. The process as defined in claim 10 or 13, wherein the pulverizing is carried out so that no Does not exceed 1000 ppm in the resultant powder.

15. The process as defined in claim 13, wherein the pulverizing is conducted under conditions that N in the resultant powder does not exceed 1000 ppm.

16. A process for producing an (Fe, Co)-B-R tetragonal type magnet alloy powder having high corrosion resistant wherein R is a rare earth metal and which has a boundary phase stabilized by Co and Al against corrosion, comprising:
providing an ingot of an alloy consisting essentially of 12–14.5 at% Nd and 0.2–3.0 at % Dy, so that the sum of Nd and Dy is 12.5–15 at %;
6–8 at % B;
0.5–8 at % Co;
0.5–3 at % Al;
not exceeding 1000 ppm C; and
the balance being at least 68 at % Fe, and
pulverizing the resultant ingot to a powder by wet milling using a solvent under the condition that the resultant powder does not contain C in an amount exceeding 1000 ppm or Cl in an amount exceeding 1500 ppm to provide a boundary phase stabilized by Co and Al against corrosion.

17. The process as defined in claims 1, 3, 10, 13, 6 or 16, in which the ingot further includes 0.1–1.0 at% of Ti, Nb or mixtures thereof.

18. The process as defined in claim 16, wherein the pulverizing is conducted under conditions that C in the resultant powder does not exceed 700 ppm.

19. The process as defined in claim 1, 3, 6 or 16, wherein the wet milling uses a solvent containing an organic chloro-fluoro-compound.

* * * * *

UNITED STATES PATENT AND TRADEMARK OFFICE

CERTIFICATE OF CORRECTION

PATENT NO. : 5,167,914

DATED : December 1, 1992

INVENTOR(S) : Setsuo FUJIMURA, et al

It is certified that error appears in the above-indentified patent and that said Letters Patent is hereby corrected as shown below:

Column 14, line 19, Claim 1, "15000ppm" should read --1500 ppm--.
Column 16, line 2, Claim 14, "no Does" should read --N does--.

Signed and Sealed this

Twelfth Day of July, 1994

Bruce Lehman

*Attest:*

BRUCE LEHMAN

*Attesting Officer*

*Commissioner of Patents and Trademarks*